US005560427A

United States Patent [19]

Jones

[11] Patent Number: 5,560,427

[45] Date of Patent: Oct. 1, 1996

[54] FRACTURING AND PROPPING A FORMATION USING A DOWNHOLE SLURRY SPLITTER

[75] Inventor: Lloyd G. Jones, Dallas, Tex.

[73] Assignee: Mobil Oil Corporation, Fairfax, Va.

[21] Appl. No.: 506,406

[22] Filed: Jul. 24, 1995

[51] Int. Cl.[6] ..... E21B 43/267

[52] U.S. Cl. ..... 166/280; 166/308; 166/74

[58] Field of Search ..... 166/278, 280, 166/308, 205, 50, 74

[56] References Cited

U.S. PATENT DOCUMENTS

| | | | |
|---|---|---|---|
| 3,151,678 | 10/1964 | Hanson et al. . | |
| 4,378,845 | 4/1983 | Medlin et al. | 166/297 |
| 4,397,353 | 8/1983 | Lacy | 166/281 |
| 4,662,451 | 5/1987 | Boade | 166/299 |
| 4,685,519 | 8/1987 | Stowe et al. . | |
| 4,887,670 | 12/1989 | Lord et al. | 166/308 X |
| 4,945,991 | 8/1990 | Jones . | |
| 5,036,917 | 8/1991 | Jennings, Jr. et al. | 166/308 X |
| 5,095,987 | 3/1992 | Weaver et al. | 166/280 X |
| 5,113,935 | 5/1992 | Jones et al. . | |
| 5,159,979 | 11/1992 | Jennings, Jr. | 166/280 |
| 5,161,613 | 11/1992 | Jones et al. . | |
| 5,161,618 | 11/1992 | Jones et al. . | |
| 5,205,360 | 4/1993 | Price | 166/308 |
| 5,417,284 | 5/1995 | Jones . | |
| 5,419,394 | 5/1995 | Jones . | |
| 5,435,391 | 7/1995 | Jones . | |

*Primary Examiner*—Frank Tsay
*Attorney, Agent, or Firm*—Ronald A. Bleeker; Malcolm D. Keen

[57] ABSTRACT

A method and apparatus for fracturing and propping a fracture interval wherein a workstring is lowered into the wellbore and a fracturing slurry comprised of a fracturing fluid and proppants is flowed down the workstring to a downhole slurry splitter which separates a portion of the fracturing fluid from the slurry and delivers it to the bottom of the fracture interval to initiate and propagate a fracture in the interval. The remaining slurry including the proppants is at the same time delivered to the top of the interval to prop the fracture as it is being formed. Alternate flowpath(s) deliver fracturing fluid and/or slurry to different levels within the interval to by-pass any sand bridges which may be formed during the fracturing operation.

19 Claims, 5 Drawing Sheets

FRACTURING AND PROPPING A FORMATION USING A DOWNHOLE SLURRY SPLITTER

DESCRIPTION

1. Technical Field

The present invention relates to a method and apparatus for fracturing and propping a subterranean formation and in one of its aspects relates to a method and apparatus for fracturing and propping art interval of a subterranean formation wherein a slurry is pumped down a wellbore where it is "split" to separate a portion of the fracturing fluid (e.g. gel) from the slurry which then flows into one end of the fracture annulus to initiate the fracture while the remaining slurry which contains the proppants enters the other end of the annulus to prop the fracture.

2. Background Art

"Hydraulic fracturing" is a well known technique commonly used to increase the productivity of subterranean formations which produce hydrocarbon fluids or the like. In a typical hydraulic fracturing operation, a fracturing fluid (e.g. gel) is pumped down a wellbore and into the formation at a pressure sufficient to initiate and enlarge a "fracture". The fracture(s) provides a network of permeable channels into the formation through which formation fluids can flow into the wellbore.

Unfortunately, however, such fractures have a tendency to close once the fracture pressure is relaxed. Accordingly, it is routine in the art to "prop" the fractures open by mixing proppants (e.g. sand, gravel, or other particulate material) with the fracturing fluid or by following the fracturing fluid with a slurry Which contains the desired "props" or proppants. The slurry flows into the fractures where the props are deposited to thereby "prop" or hold the fractures open after the pressure is relaxed and the well is put on production.

As will be understood by those skilled in this art, problems still remain in fracturing and propping some formations, especially where the formation to be fractured relatively thick (e.g. 50 feet or more) and/or is comprised of highly permeable and/or heterogeneous strata. For example, it is common to lose liquid from the slurry into the initial fracture which, in turn, causes the props, e.g. sand, to collect in the well annulus adjacent the initial fracture thereby forming a "sand bridge" in the annulus.

These sand bridges block further flow of fracturing gel and/or slurry through the well annulus thereby preventing the further delivery of the necessary fluids to other levels or zones within the interval to be fractured. This is true even where some of these other zones may have previously experienced some break-down before a sand bridge was formed. The formation of sand bridges during the fracturing operation usually results in fractures which extend only across a portion of the desired fracture interval and/or in fractures which are inadequately propped. In either event, the full benefits of the fracturing operation will not be realized.

Due to the problems associated with the formation of sand bridges in the well annulus, it is common to use a series of individual, conventional fracturing operations to fracture and prop thick formations and/or heterogeneous formations. Of course, as will be recognized by those skilled in the well completion art, this repetition is expensive and time consuming and can seriously affect the overall economics of a particular well.

To overcome the expense and time involved in carrying out multiple, individual fracturing operations in a single wellbore interval, methods have been proposed recently wherein the fracturing of such an interval can be performed in a single operation by simultaneously delivering the fracturing fluid to different levels within the interval; for example see U.S. Pat. No. 5,161,618 to Jones et al..

Another method for fracturing long intervals in a single operation is disclosed in co-pending and commonly-assigned, U.S. Pat. application Ser. No. 08/286,367, filed Aug. 5, 1994, wherein alternating slugs of (a) a fracturing fluid, e.g. gel, and (b) a slurry containing proppants are pumped down a workstring and into the same end of the well annulus to initiate, enlarge, and prop the fracture (s) as it forms across the interval. Alternate flowpaths are provided within the well annulus to insure that the gel and/or slurry will continue to be delivered to all levels within the interval, even if a sand bridge(s) forms within the annulus before the fracturing operation is completed.

Still another method for fracturing and propping long or heterogeneous interval of a formation in a single operation is disclosed in U.S. Pat. No. 5,417,284, issued May 23, 1995, wherein a fracturing fluid (e.g. gel) is pumped from the surface into one end of the fracture annulus while at the same time, a slurry containing proppants is pumped from the surface into the other end of the annulus. If a sand bridge(s) forms within the annulus during the fracturing operation, the fracturing fluid and/or slurry continues to be delivered to different levels within the interval through alternate flowpaths, e.g. shunt tubes, which are provided in the fracture annulus.

In carrying out the method of U.S. Pat. No. 5,417,284, both the gel and the slurry are individually pumped from the surface through individual flowpaths. This requires that either the gel or the slurry to be pumped from the surface down the "backside" of the wellbore (i.e. the annulus between the workstring and the wellbore) while the other fluid is being pumped from the surface down the workstring.

In addition to requiring larger volumes of each of the respective fluids (i.e. gel and slurry) to fill both the workstring and the well annulus all the way to the surface, there is a natural reluctance on the part of those skilled in the art to pump either the gel or the slurry down the backside of the wellbore since this will require substantially altering the valving which is normally associated with standard fracturing equipment of this type. Also, by individually pumping both the slurry and the gel from the surface, two separate pumping systems, two mixing/holding tanks, etc. will be required thereby adding significantly to the cost of the completion operation.

SUMMARY OF THE INVENTION

The present invention provides a method and apparatus for fracturing and propping a thick and/or heterogeneous fracture interval of a subterranean formation which is traversed by a wellbore. Basically, the method is carried out by positioning the lower section of a workstring (e.g. screen) adjacent the fracture interval. The lower section of the workstring includes alternate flowpaths for carrying fluids to different levels within the annulus should a sand bridge (s) form before the fracturing operation is completed.

A fracturing slurry comprised of a fracturing fluid (e.g. gel) and proppants (e.g. sand) is flowed down the workstring to a downhole slurry splitter within the lower section of the workstring where a portion of the gel is separated from the slurry. The separated gel is flowed out or near the bottom of the lower section into the fracture interval where it initiates and propagates a fracture in the interval. The remaining slurry including the proppants is at the same time flowed into the top of the interval to prop the fracture as it is being formed. The alternate flowpaths are available to deliver the fracturing fluid and/or slurry to different levels within the interval to thereby by-pass any sand bridges which may form within the well annulus during the fracturing operation.

More specifically, the present invention involves a fracturing workstring which may include a screen commonly used in gravel pack operations and which extends from the surface and is positioned so that its lower section will extend substantially across the fracture interval. The lower section carries one or more alternate flowpaths, e.g. at least one shunt tube, which extend through the fracture interval and are open at its ends and may have a plurality of outlets spaced along its length which, in turn, provide for the delivery of fluids to different levels within the fracture interval.

A downhole slurry splitter is mounted (preferably releasably mounted) within the lower section of workstring and is comprised of a conduit which extends into the lower section and out or near the bottom of the workstring. A sealing means between the conduit and the workstring blocks downward flow of slurry through the lower section of the workstring. The conduit has an inlet, e.g. a screen section, which allows fracturing fluid to flow into the conduit while blocking the flow of proppants. A fishing neck or the like may be attached to the upper end of the conduit whereby, if desired, the splitter can be retrieved to the surface once the fracturing operation has been completed.

In operation, the workstring is lowered into the wellbore and a slurry of fracturing fluid (e.g. gel) and proppants (e.g. sand) is pumped down the workstring. As the slurry reaches the splitter, a portion of the gel is separated from the slurry since the gel can readily flow through the inlet of the conduit while substantially any flow of the proppants will be blocked. The separated gel flows down the conduit and out the bottom of the workstring to initiate a fracture in the fracture interval.

In some instances, a slug of fracturing fluid (e.g. gel) may be injected prior to the injection of the slurry whereupon the splitter will allow a portion of the slug to initiate and expand the fracture before the slurry begins to deliver props thereto. The amount of gel which will flow through the splitter is controlled by choke or restriction placed in the conduit downstream from the inlet.

The separated gel continues to flow into the lower end of annulus while the slurry (i.e. the proppants and the remaining gel) will flow through outlet openings in the lower section above the sealing means and into the top of fracture annulus where it deposits proppants in the fracture as the fracture is being formed and expanded by the gel. If a sand bridge(s) forms in the annulus during the fracturing operation, the slurry can by-pass these bridges through the shunt tube(s) on the workstring.

In most instances, it is desirable to "unload" and remove the workstring once the fracturing operation has been completed. To do this, the downhole slurry splitter is removed by a wireline tool and a washpipe is lowered into the lower section of the workstring. A wash fluid (e.g. water) is pumped down the washpipe and out unloading ports in the lower section to churn-up and wash the sand upward through the outlet openings in the lower section and up to the surface through the workstring. When sufficient proppants are removed, the workstring can then be retrieved to the surface.

It is also possible to use the present invention to fracture, prop, and gravel pack an interval within a well, all with a single operation. In this embodiment, a gravel pack screen forms the lower section of the workstring. The slurry splitter is position in the screen and is comprised of a conduit which extends along the screen and out or near the bottom thereof and which has an inlet near its upper end.

In operation, the slurry is pumped down the workstring, through outlets in the lower section, and into the top of the fracture annulus. As the slurry flows downward in the annulus, a portion of the fracturing fluid (e.g. gel) will be separated from the slurry when it flows through the screen which prevents the flow of any proppants therethrough. The separated gel then flows through the inlet of the conduit and is delivered through the lower end of the screen to the lower end of annulus to initiate and expand a fracture. Again, the amount or portion of the gel which passes through the conduit can be controlled by a choke or the like in the conduit. The remaining gel and proppants continue to flow downward in fracture annulus to prop the fracture as it is being formed.

Again, if a sand bridge forms in the annulus, alternate flowpaths deliver the slurry/fracturing fluids to other levels in the fracture intervals. After forming and propping the fracture across the interval, the flow of slurry is continued until the annulus around the gravel pack screen is packed with gravel (i.e. proppants) to thereby form a gravel-pack completion across the fracture interval.

BRIEF DESCRIPTION OF THE DRAWINGS

The actual construction, operation, and the apparent advantages of the present invention will be better understood by referring to the drawings which are not necessarily to scale and in which like numerals identify like parts and in which.

BEST KNOWN MODE FOR CARRYING OUT THE INVENTION

Figure 1:
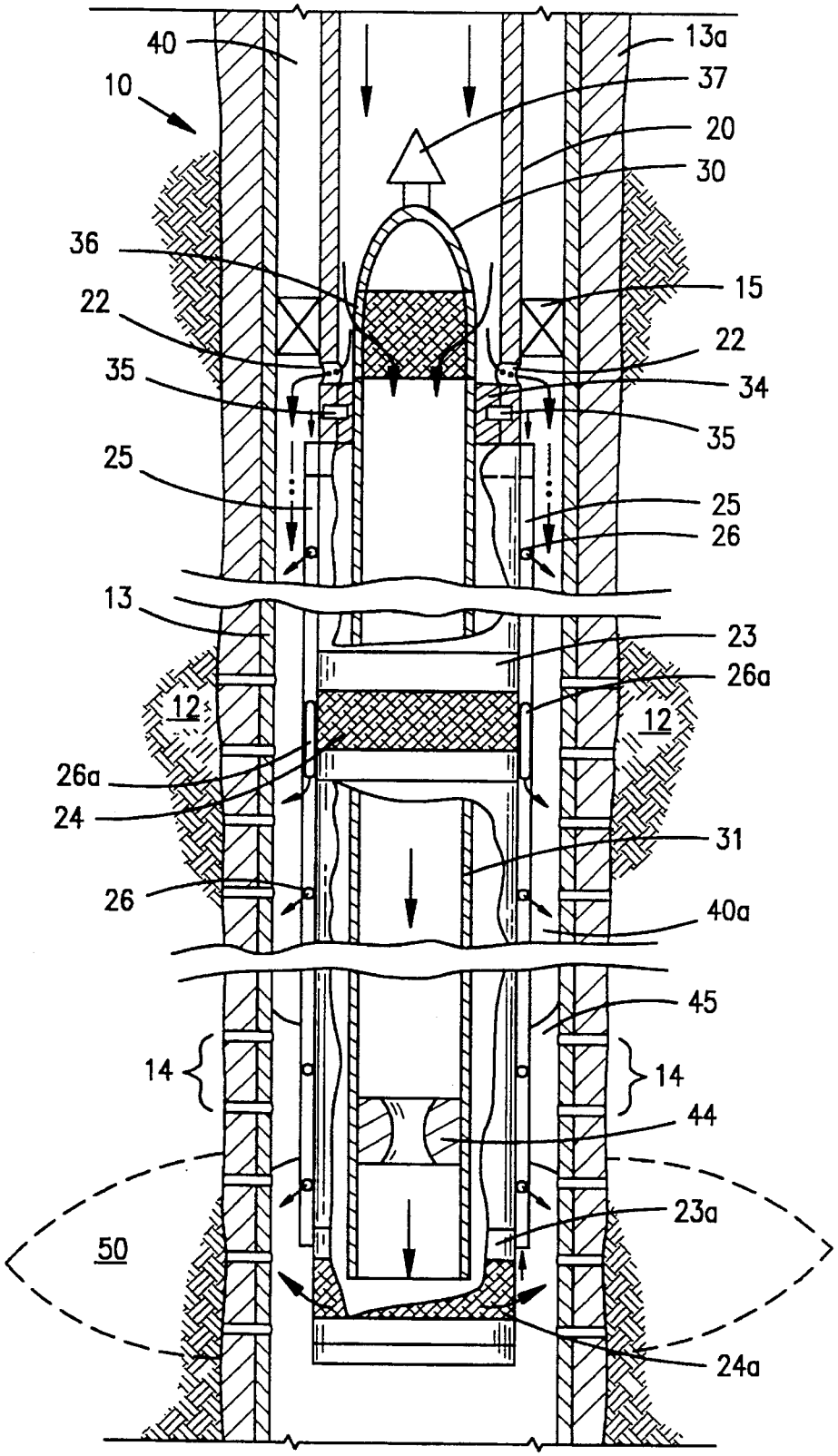
FIG. 1 is a elevational view, partly in section, of an apparatus which includes a downhole slurry splitter in accordance with the present invention as shown in an operable position within a wellbore.

Referring more particularly to the drawings, FIG. 1 illustrates the lower end of a producing and/or injection well 10. Well 10 has a wellbore 11 which extends from the surface (not shown) through fracture interval 12. Wellbore 11 is typically cased with a casing 13 which is cemented 13*a* in place. While the method of the present invention is illustrated primarily as being carried out in a vertical cased wellbore, it should be recognized that the present invention can equally be used in open-hole and/or underreammed completions as well as in inclined and horizontal wellbores as the situation dictates.

As illustrated, fracture interval 12 is a thick formation having a ;substantial length which extends vertically along wellbore 11. Casing 13 may have perforations 14 throughout fracture interval 12 or may be perforated at selected levels within the fracture interval. Since the present invention is also applicable for use in horizontal and inclined wellbores, the terms "upper and lower" "top and bottom", as used herein are relative terms and are intended to apply to the respective positions within a particular wellbore while the term "levels" is meant to refer to respective positions lying along the wellbore between the terminals of the fracture interval 12.

A fracturing workstring 20 which extends from the surface (not shown) is positioned in wellbore 11 so that its lower section will extend Substantially across fracture interval 12. The lower section of fracturing workstring 20 has outlet openings 22 which will lie at or near the top of interval 12 when the workstring is in an operable position within the wellbore 11. A packer 15 is carried on the exterior of workstring 20 just above outlets 22 to isolate the fracture annulus 40 adjacent fracture interval 12 during the fracturing operation.

One or more alternate flowpaths, e.g. shunts tubes 25, are radially-spaced around the workstring 20 and preferably extend longitudinally from just below outlets 22 to the lower end of the workstring 20. Each of these shunt tubes may be open only at its upper and lower ends or each may have a plurality of openings 26 spaced along its length which provide "alternate flowpaths" for the delivery of fluids to different levels within the fracture interval 12 for a purpose to be discussed in detail below. Shunts tubes of this type have been used to provide alternate flowpaths for fluids in a variety of different well operations, see U.S. Pat. Nos. 4,945,991; 5,082,052; 5,113,935; 5,161,613; 5,161,618; and 5,417,284.

While openings 26 in each of the shunt tubes 25 may be a radial opening extending from the front of the tube, preferably the openings extend from each side of the shunt tube 25, as shown. Further, it is preferred that an exit tube **26*a* (only two shown) be provided for each opening 26** as shown in U.S. Pat. No. 5,419,394 issued May 30, 1995, which is incorporated herein by reference.

The portion of workstring 20 below outlets 22 has a plurality of radial, "unloading" ports 23 spaced longitudinally along its axis. Each of these ports 23 may be in the form of a coupling which, in turn, has a screen section 24 or may be openings (not shown) covered by a screen or the like which allows fluids to flow through in or out of ports 23 but which prevents particulate material from flowing into workstring 20, as will be explained below.

Positioned within the lower portion of workstring 20 is downhole slurry splitter 30. Splitter 30 comprises a conduit 31 which extends from above outlets 22, through the lower portion of the workstring, and may extend out through an opening (not shown) in the bottom of the workstring. However, in practice, conduit 31 will more likely terminate within the lower end of workstring 20 and flow will exit through an unloading port **23*a* or other openings near the lower end of the workstring which allow fluid to flow out by block the flow of particulates into the workstring. Preferably, the diameter of conduit 31 will b relatively large (e.g. about 90% of the diameter of workstring 20) so that any substantial flow between conduit 31 and the interior of workstring 20** is limited.

Conduit 31 carries a sealing means 34 thereon which is positioned to block downward flow through the workstring below outlets 22. Sealing means 34 is fixed to conduit 31 and may be releasably attached to workstring 20 by a shear pin(s) 35 or the like for a purpose described below.

An inlet 36 is provided at or near the upper end of conduit 31 to allow fluid but not particulates to enter the conduit. As shown, inlet 36 is a section of screen incorporated or coupled into the conduit but it should be recognized that a plurality of slots or ports covered by screen or the like can be used equally as well. It is only necessary that inlet 36 allows fracturing fluid (e. g. gel) to flow therethrough while blocking flow of any particulates therethrough. A fishing neck 37 or the like may be attached to the upper end of splitter 30 for a purpose described later.

In operation, if wellbore 11 extends for a distance substantially below the bottom of fracture interval 12, the wellbore is blocked-off adjacent the lower end of fracture interval 12 by a plug or packer (not shown), as will be understood in the art. Fracturing workstring 20 is lowered into wellbore 11 which, in turn, forms a well annulus 40 between workstring 20 and the wellbore 11. Packer 15 is set to isolate that fracture annulus **40*a* which lies adjacent fracture interval 12**.

The slurry used in the present invention can be comprised of a mixture of any well-known fracturing fluid commonly used for fracturing formation (e.g. water, muds, etc.) and well-known proppants (e.g. gravel and/or sand). Preferably the fracturing fluid used is one of the many commercially-available "gels" which are routinely used in conventional fracturing operations (e.g. Versagel, product of Halliburton Company, Duncan, Okla.). The slurry is mixed at the surface and is flowed down the workstring 20.

As the slurry reaches splitter 30, a portion of the fracturing fluid (e.g. gel) is separated from the slurry since the gel will flow through inlet 36 into conduit 31 while any substantial flow of proppants will be blocked therethrough. The separated gel flows down conduit 31 and out the bottom of workstring 20 and into the lower end of annulus **40*a* where it fills the annulus and initiates fracture 50 in interval 12**. As will be recognized by those skilled in the art, it is easier to initiate and expand a fracture using a substantially proppant-free fluid (e.g. gel) than it is when a proppant-laden slurry is used as the initial fracturing fluid.

After a portion of the gel is separated at splitter 30, the proppants and the remaining gel will flow through outlets 22 and into the top of fracture annulus **40*a* as the separated gel flows into the lower end of annulus 40*a*. The slurry flows downward into annulus 40*a*** where it will deposit proppants in the fracture as the fracture is being formed and expanded by the gel.

Under normal conditions such as those in conventional fracturing techniques, the slurry will lose liquid as it flows into the formation and proppants (i.e. particulate material) will settle out in the annulus **40*a* at a point where the fracture is being formed. This results in the formation of a sand bridge (45 in FIG. 1**) in the annulus which, in turn, blocks flow of gel from below the sand bridge and the flow of slurry from above the sand bridge. Even though the gel flowing into the lower end of the annulus may continue to enlarge the fracture, no slurry can reach the enlarged portion of the fracture and accordingly, this portion of the fracture will remain unpropped.

In accordance with the present invention, the flow of slurry (i.e. remaining gel and proppants) is continued through the upper end of the annulus **40*a* while separated gel is flowed through the lower end thereof. The slurry, even if blocked by sand bridge 45 in annulus 40***a*, is still free to flow into the open, upper ends of shunts tubes 25 and out the openings 26 therein. It can be seen that shunts 25 provide a bypass around bridge 45 and can deliver either the slurry and/or the gel to the different levels within fracture intervals whereby the gel can expand fracture 50 while the slurry can flow into and prop the enlarged fracture as it is being formed. The flow of slurry is continued down the workstring 20 until substantially the entire interval 12 is fractured and propped.

It should be recognized that both the composition and the flow rate of the original slurry can be adjusted whereby sufficient gel can be separated downhole to significantly enhance the fracturing operation while leaving sufficient gel in the remaining slurry to suspend and ultimately deposit the proppants in the resultant fracture. That is, the original slurry may contain more gel than would normally be present in a typical fracturing slurry whereby the remainder of the split slurry will still contain enough gel to suspend and carry the proppant into the fracture.

The amount of gel which will be separated through splitter 30 can be adjusted by positioning choke 44 in conduit 31. The size of a particular choke will determine the amount of gel which can flow through conduit 31 at a particular flowrate; hence, will determine how much gel will be separated by splitter 30. Choke 44 can be positioned anywhere within the conduit, e.g. lower end as shown.

Figure 2:
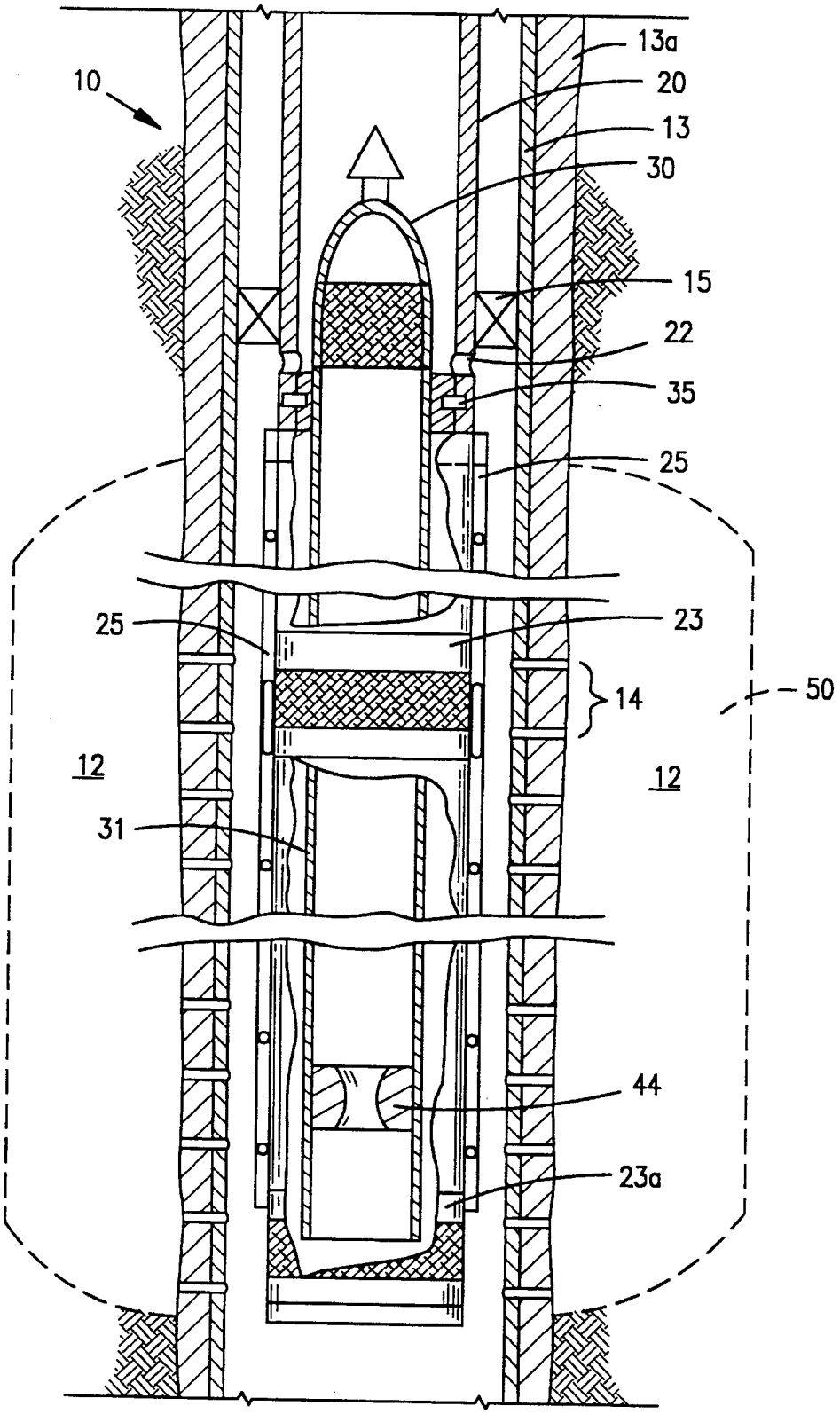
FIG. 2 is an elevational view, partly in section, similar to that if FIG. 1 wherein the fracturing operation has been completed.

As will be understood by those skilled in the art, except in unconsolidated formations, it is usually desirable to remove fracturing workstring 20 after the completion of the fracturing operation. This may be difficult due to the proppants, e.g. sand, which not only fill the fracture 50 but also fill and remain in annulus 40*a* after the fracturing and propping operation is completed (FIG. 2). To remove workstring 20, fracture annulus 40*a* has to be "unloaded" (i.e. remove at least a portion of the proppants surrounding workstring 20).

Figure 3:
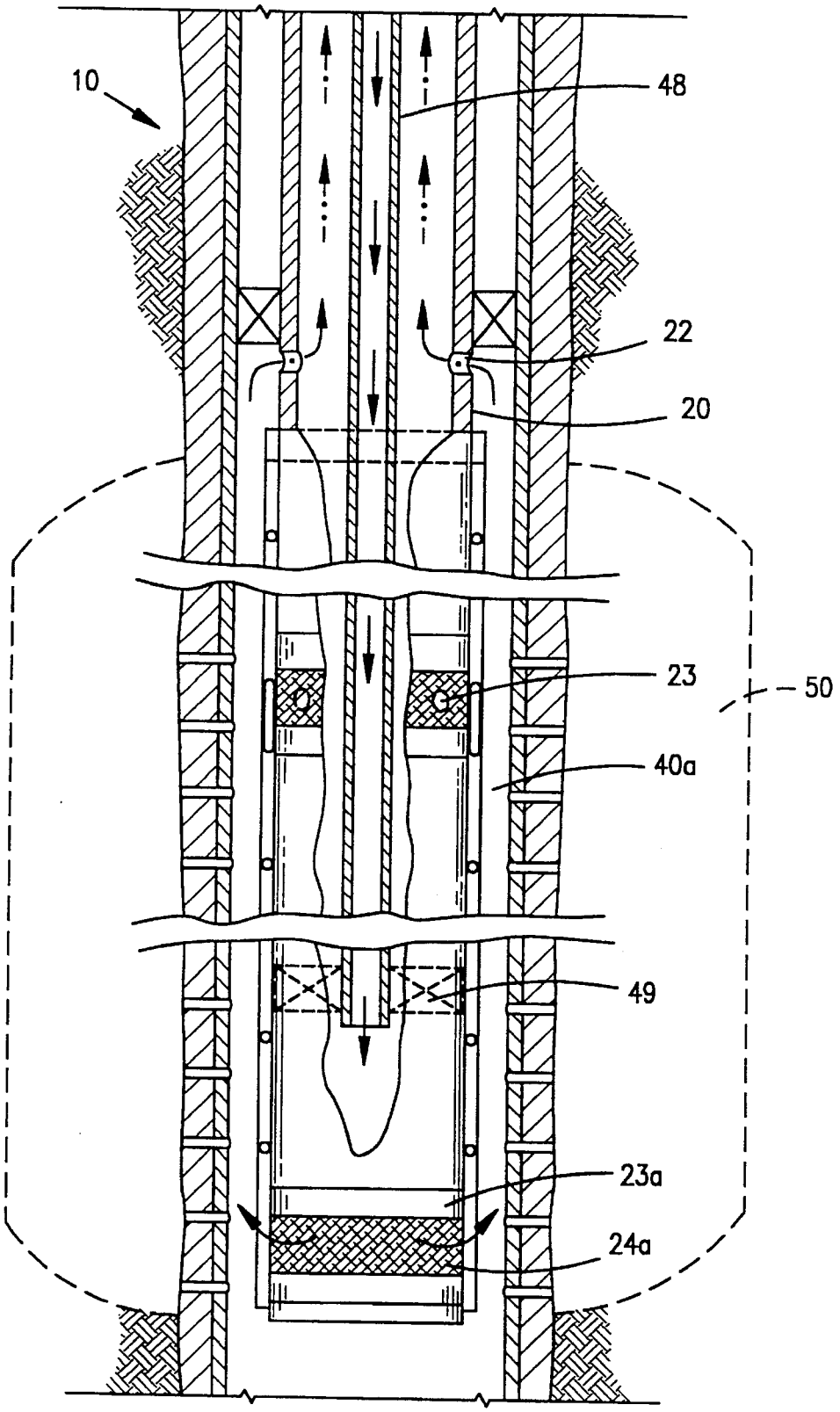
FIG. 3 is an elevational view, partly in section, similar to that of FIG. 1 wherein the downhole slurry splitter has been removed and replaced with a washstring to "unload" and remove the apparatus from the wellbore.

To accomplish this, downhole slurry splitter 30 is removed by lowering a standard, wireline fishing tool (not shown) to couple onto fishing neck 37. Pulling up on the wireline will shear the pin(s) 35 to release splitter 30 which is then retrieved to the surface by the wireline. Washpipe 48 is lowered from the surface into the lower section of workstring 20 (FIG. 3). The washpipe carries a flow restricting means (e.g. packer 49) on its external surface near its lower end. As will be recognized, packer 49 does not have to fully block upward flow through workstring 20 but merely has to restrict flow so that the majority of the flow from the washstring will be downward within the workstring 20.

A wash fluid (e.g. water) is pumped down washpipe 48 and out into the lower portion of workstring 20. The lower end of washpipe 48 is shown as being at an intermediate position within the lower portion of the workstring 20 but it should be understood that the washpipe will normally be initially positioned at the upper end of the lower section of workstring 20 (i.e. packer 49 will be just below outlets 22) and then lowered within the workstring 20 as the proppants are washed out of annulus 40*a*.

As the wash fluid flows downward in lower section under pressure, it will flow out unloading ports 23 to churn-up and wash the sand in annulus 40*a* upward through outlet openings 22 and on to the surface through the upper portion of workstring 20. As the proppants are washed from the upper portion of annulus 40*a*, washpipe 48 is lowered to continue washing proppants from the lower portions of the annulus in the same manner. When sufficient proppants are removed, workstring 20 will loosen and can then be retrieved to the surface.

Figure 4:
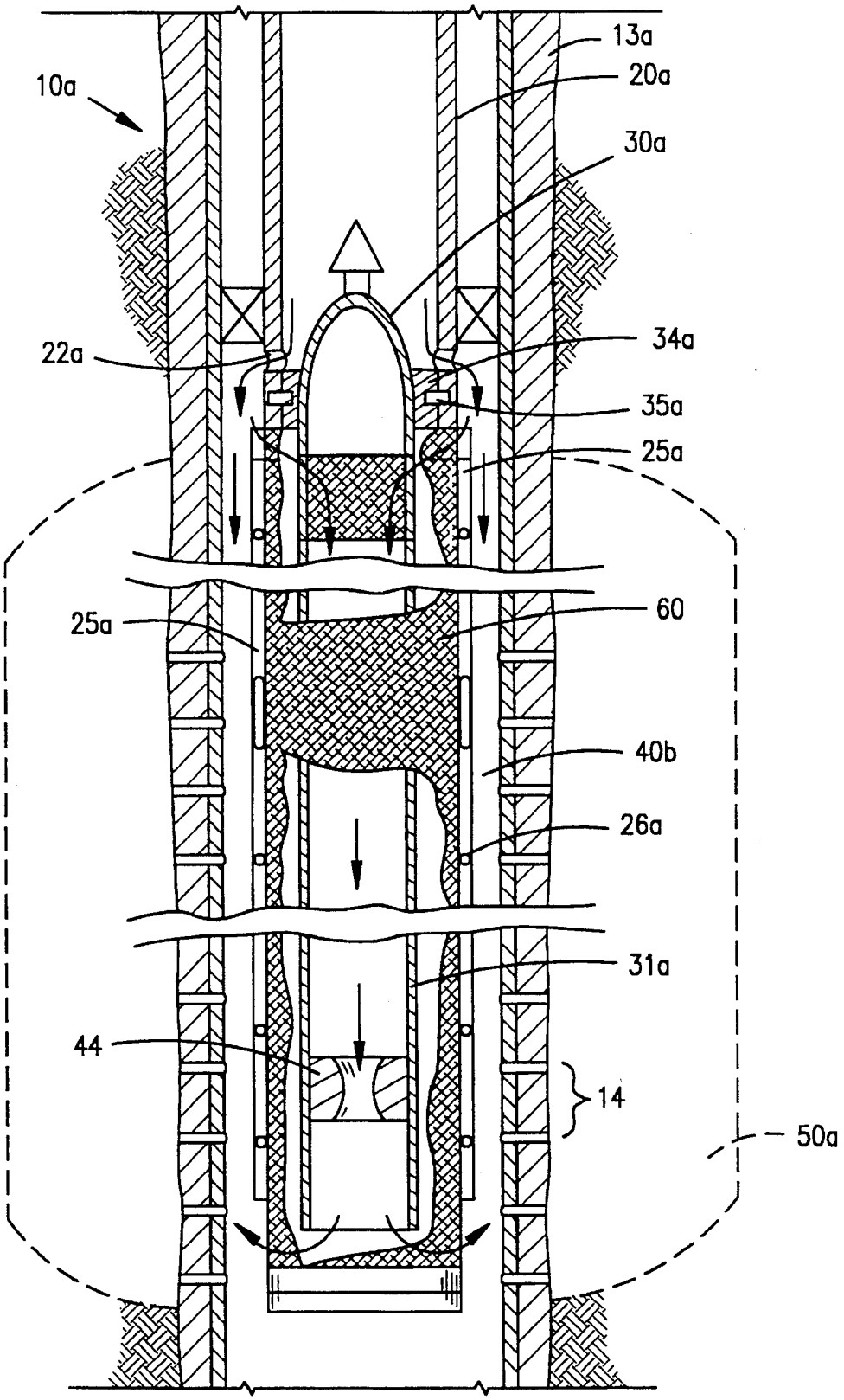
FIG. 4 is an elevational view, partly in section, of a further embodiment of the apparatus of FIG. 1 including a further embodiments of a downhole slurry splitter.

It is also possible to use the present invention to fracture, prop, and gravel pack an injection or product ion interval within a well, all with a single operation. As illustrated in FIG. 4, a gravel pack screen 60 is connected into the lower end of workstring 20*a*. "Gravel pack screen" or "screen" as used herein, is intended to be generic and to include screens, slotted pipes, screened pipes, perforated liners, pre-packed screens and/or liners, combinations of same, etc. which are used in well completions of this general type. Screen 60 may be of a continuous length, as shown, or it may be comprised of a plurality of screen segments connected together by subs or "blanks". At least one shunt tube(s) 25*a* (two shown radially-spaced around screen 60) extends substantially throughout fracture interval 12. Tube(s) 25*a* may be open at both ends and may have one or more openings 26*a* spaced along its length.

Slurry splitter 30*a* is positioned within screen 60 and is comprised of a conduit 31*a* which extends to within the lower portion of screen 60. A sealing means (e.g. packer 34*a*) or other type "cross-over" (not shown) is fixed on conduit 21*a* and is releasably secured within workstring 20 by shear pin(s) 35*a* or the like. Conduit 21*a* has an inlet 36*a* (e.g. screen section) near its upper end below outlets 22*a* in workstring 20*a*.

In operation, slurry is mixed at the surface and is pumped down workstring 20*a* and out outlet 22*a* into the top of fracture annulus 40*b*. As the slurry flows downward in annulus 40*b*, a portion of the fracturing fluid (e.g. gel) will be separated from the slurry by passing through the upper portion of screen 60 which, in turn, prevents the flow of any proppants therethrough. The separated gel then flows into conduit 21*a* through inlet 36*a* and out through the lower portion of screen 60 into the lower end of annulus 40*b* to initiate and expand a fracture 50*a*. The remaining gel and proppants continue to flow downward in annulus 40*b* to prop the fracture in the same manner as described above.

If a sand bridge (not shown) forms in annulus 40*b*, shunt (s) 25*a* provide alternate flowpaths for delivering the slurry/fracturing fluids to other levels in the fracture interval in the same manner as described above. After achieving the desired fracture across the fracture interval, the flow of slurry is continued until the annulus 40*b* around gravel pack screen is filled or packed with gravel (i.e. proppants). Since the screen is to be left in the wellbore, there is no need to "unload" the annulus surrounding the screen. The slurry splitter 30*a* can then removed to the surface as described above.

Figure 5:
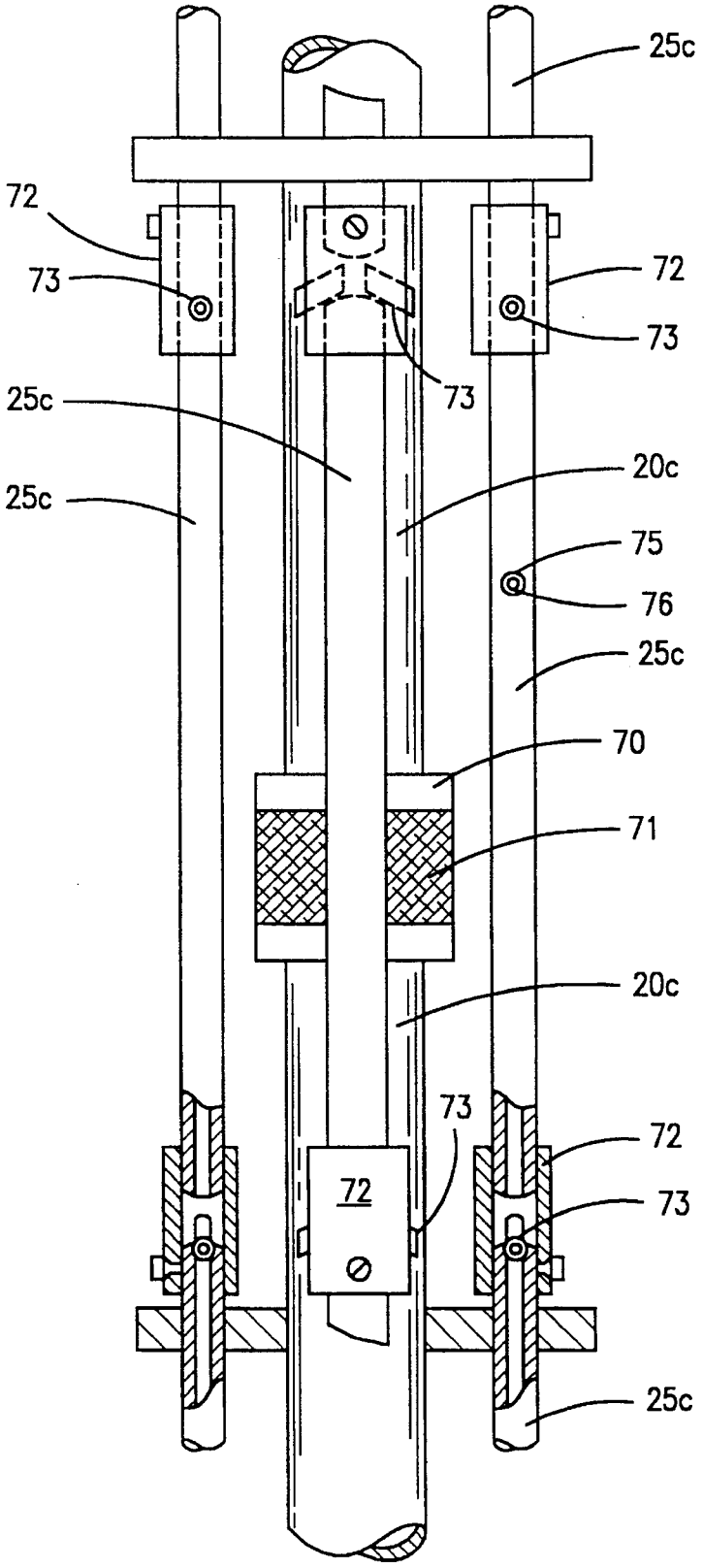
FIG. 5 is an elevational view, partly in section, of still a further embodiment of the apparatus FIG. 1.

FIG. 5 illustrates still a further embodiment of the present invention which is similar to that of FIG. 1; the primary different being in the shunt tubes 25*c*. Shunt tubes 25*c*, as shown, run along and are attached to sections 20*c* of the fracturing workstring. Sections of the workstring 20*c* are coupled together by threaded couplings 70 (only one shown) or the like. Each coupling 70 includes an inlet section (e.g. screen 71 or the like) which allows flow of fluid therethrough but which prevents flow of proppants therethrough in the same manner as before. Aligned shunt tubes 25*c* are joined together by connectors 72 into which outlets 73 are mounted.

Preferably, each outlet 73 is a hardened conduit which resists corrosion (e.g. tungsten carbide) which is set in an opening through the side of a connector and is positioned to direct flow from a shunt tube into the well annulus when in an operable position within the wellbore. Further, if additional outlets are desired along the length of tubes 25*c*, a "button" 75 of hardened material (e.g. tungsten carbide) is secured to the tube at the desired intervals and then tapped to provide and outlet opening 76 therethrough. The operation of the fracturing workstring 20*c* is basically the same as that described above in relation to FIG. 1.

What is claimed is:

1. A method for fracturing and propping a fracture interval of a subterranean formation which is traversed by a wellbore, said method comprising:

positioning a workstring in the wellbore to form a well annulus between said Workstring and said wellbore;

flowing a slurry comprising a fracturing fluid and proppants down said workstring;

separating a portion of said fracturing fluid from said slurry;

flowing said separated portion of said fracturing fluid into one end of that portion of said well annulus which lies adjacent to said fracture interval to thereby initiate a fracture within said fracture interval;

flowing the remainder of said slurry containing proppants into the other end of said fracture interval annulus while continuing to flow said separated fracturing fluid into said one end of said fracture interval annulus.

2. The method of claim 1 wherein said separated portion of said fracturing fluid is flowed into the bottom of said fracture interval annulus and said remaining slurry is flowed into the top of said fracture interval annulus.

3. The method of claim 1 including:

delivering said separated fracturing fluid and/or said remaining slurry through an alternate flowpath to different levels within said fracture interval annulus while continuing to flow said fracturing fluid through said one end of said fracture interval annulus and said slurry through said other end of said fracture interval annulus.

4. The method of claim 3 wherein said alternate flowpaths are provided by at least one shunt tube which extends along said workstring and substantially through said fracture interval.

5. The method of claim 4 including:

isolating said portion of said annulus which lies adjacent said fracture interval prior to flowing said fracturing fluid into the bottom of the fracture interval annulus.

6. The method of claim 5 wherein said portion of said fracturing fluid is separated from said slurry by passing said fracturing fluid through a downhole slurry splitter while blocking flow of said proppants therethrough.

7. The method of claim 6 wherein said fracturing fluid is a fracturing gel and said proppants are sand.

8. The method of claim 1 including:

ceasing flow of said slurry down said workstring when said fracture interval has been fractured and propped; and flowing a wash fluid down said wellbore to unload said workstring whereby said workstring can be removed from said wellbore.

9. A method for fracturing, propping, and gravel-packing a fracture interval of a subterranean formation which is traversed by a wellbore, said method comprising:

positioning a workstring in the wellbore to form a well annulus between said workstring and said wellbore, said workstring including a gravel pack screen which lies adjacent said fracture interval to form a fracture interval annulus when said workstring is in place within said wellbore;

flowing a slurry comprising a fracturing fluid and proppants down said workstring;

separating a portion of said fracturing fluid from said slurry;

flowing said separated portion of said fracturing fluid into one end of that portion Of said well annulus which lies adjacent to said fracture interval to thereby initiate a fracture in said fracture interval;

flowing the remainder of said slurry containing proppants into the other end of said fracture interval annulus while continuing to flow said separated fracturing fluid into said one end of said fracture interval annulus; and continuing to flow said slurry through said isolated fracture interval annulus to fracture and prop said interval and to deposit proppants in said isolated fracture interval annulus around said gravel pack screen.

10. The method of claim 9 including:

delivering said separated fracturing fluid and/or said remaining slurry through an alternate flowpath to different levels within said fracture interval annulus while continuing to flow said fracturing fluid through said one end of said fracture interval annulus and said slurry through said other end of said fracture interval annulus.

11. An apparatus for fracturing and propping a fracture interval of a subterranean formation which is traversed by a wellbore, said apparatus comprising:

a workstring adapted to extend from the surface and carry a fracturing slurry comprised of a fracturing fluid and proppants, said workstring having a lower section which lies adjacent the fracture interval when said workstring is in an operable position within the wellbore;

a slurry splitter in said lower section adapted to separate a portion of the fracturing fluid from said slurry and deliver said separated fluid out the bottom of said lower section; and outlet means for conveying slurry from said workstring into the wellbore at a point substantially adjacent the upper end of the fracture interval.

12. The apparatus of claim 11 wherein said slurry splitter comprises:

a conduit mounted in said lower section of said workstring having one end extending substantially through said lower section; and inlet means on said conduit for allowing flow of fracturing fluid therethrough while blocking flow of proppants therethrough.

13. The apparatus of claim 11 wherein said outlet means for conveying slurry from said workstring comprises:

outlet ports through the upper end of said lower portion.

14. The apparatus of claim 13 wherein said slurry splitter further comprises:

sealing means fixed to the external surface and positioned below said outlet ports to block downward flow through the lower section of said workstring.

15. The apparatus of claim 14 wherein said slurry splitter further comprises:

means for releasably securing said conduit within said lower section of said workstring.

16. The apparatus of claim 11 including:

at least one alternate flowpath carried by said lower section and extending substantially through the fracture interval for delivering fracturing fluid and/or slurry to different levels within said fracture interval.

17. The apparatus of claim 16 wherein said at least one alternate flowpath comprises:

a plurality of shunt tubes extending along the longitudinal axis of said lower section, each of said shunt tubes having a plurality of outlets spaced along its length.

18. The apparatus of claim 16 wherein said at least one alternate flowpaths comprises:

a plurality of shunt tubes extending along the longitudinal axis of said lower section, each of said shunt tubes comprising two aligned conduits coupled together with a connector having an outlet therein.

19. The apparatus of claim 11 wherein said lower section of said workstring comprises:

a screen means for allowing flow of fluid therethrough while blocking the flow of proppants therethrough;

and wherein said slurry splitter comprises:

a conduit mounted in said lower section of said workstring having one end extending substantially through said screen means; and inlet means on said conduit for allowing flow of fracturing fluid into said conduit.

* * * * *